US008487974B2

(12) United States Patent
Igarashi et al.

(10) Patent No.: US 8,487,974 B2
(45) Date of Patent: Jul. 16, 2013

(54) OPTICAL SCANNING APPARATUS AND COLOR IMAGE FORMING APPARATUS USING THE SAME

(75) Inventors: Jun Igarashi, Nikko (JP); Kiyoto Toyoizumi, Susono (JP)

(73) Assignee: Canon Kabushiki Kaisha (JP)

( * ) Notice: Subject to any disclaimer, the term of this patent is extended or adjusted under 35 U.S.C. 154(b) by 48 days.

(21) Appl. No.: 13/172,114

(22) Filed: Jun. 29, 2011

(65) Prior Publication Data

US 2011/0316960 A1 Dec. 29, 2011

(30) Foreign Application Priority Data

Jun. 29, 2010 (JP) ..... 2010-147389

(51) Int. Cl.
*B41J 15/14* (2006.01)
*B41J 27/00* (2006.01)

(52) U.S. Cl.
USPC ..... 347/244; 347/258

(58) Field of Classification Search
USPC ..... 347/124, 140, 158, 228, 240, 229, 347/231–235, 243, 244, 248–250, 251–254, 347/258–261
See application file for complete search history.

(56) References Cited

U.S. PATENT DOCUMENTS 6,389,260 B1 * 5/2002 Kataoka et al. ..... 399/298
6,449,451 B2 * 9/2002 Tsuruya et al. ..... 399/223
6,819,897 B2 * 11/2004 Kita ..... 399/223
7,502,577 B2 * 3/2009 Kitozaki et al. ..... 399/258
7,567,772 B2 * 7/2009 Shiraishi ..... 399/223
7,684,730 B2 * 3/2010 Furuta et al. ..... 399/121
7,750,931 B2 * 7/2010 Shimomura ..... 347/241
7,778,570 B2 * 8/2010 Numagami et al. ..... 399/111
2003/0165346 A1 * 9/2003 Yamaguchi et al. ..... 399/223
2006/0222413 A1 * 10/2006 Nagae ..... 399/262

FOREIGN PATENT DOCUMENTS

JP 2005-091966 A 4/2005

* cited by examiner

*Primary Examiner* — Hai C Pham

(74) *Attorney, Agent, or Firm* — Rossi, Kimms & McDowell LLP

(57) ABSTRACT

To provide high flexibility in the arrangement of optical paths toward a plurality of photosensitive members and not to cause an increase in size of an image forming apparatus even when a cartridge capacity is increased, provided is an image forming apparatus including: light source units; a deflecting unit for deflecting a plurality of light beams for scanning; a plurality of photosensitive members; an imaging optical system for imaging the light beams deflected for scanning; and a plurality of toner containers, in which the toner containers are different in capacity, and an optical path length from the photosensitive member for the same color as the toner container having a large capacity to the deflecting surface of the deflecting unit is longer than an optical path length from the photosensitive member for the same color as the toner container having a small capacity to the deflecting surface of the deflecting unit.

8 Claims, 12 Drawing Sheets

OPTICAL SCANNING APPARATUS AND COLOR IMAGE FORMING APPARATUS USING THE SAME

BACKGROUND OF THE INVENTION

1. Field of the Invention

The present invention relates to an optical scanning apparatus and a color image forming apparatus using the optical scanning apparatus. The present invention is suitable for a color image forming apparatus such as a laser beam printer (LBP), a digital copying machine or a multi-function printer, which employs an electrophotographic process.

2. Description of the Related Art

Conventionally, in an optical scanning apparatus such as a laser beam printer (LBP), a light beam emitted from a light source unit is subjected to optical modulation in accordance with the image signal, and the light beam that has been subjected to the optical modulation is periodically deflected by an optical deflector constituted, for example, of a polygon mirror. Then, the light beams are condensed by an imaging optical system having fθ characteristics in spots on photosensitive members each serving as an image bearing member, to perform optical scanning and record an image.

Further, in a color image forming apparatus in recent years, in order to satisfy the demand for downsizing the apparatus, one deflecting unit, which had heretofore been provided for each of four colors (yellow, magenta, cyan, black) on one-on-one basis, is shared among the four colors. Specifically, a so-called opposing optical scanning apparatus is adopted in which two imaging optical systems are arranged on each side so as to be symmetric with respect to the rotational axis of the optical deflector. Then, a plurality of reflection mirrors are used in each optical path to fold the optical path to guide the light beam to each of the photosensitive members each serving as an image bearing member. Further, as color image forming apparatus in which the optical scanning apparatus are mounted, there have been manufactured ones of a type including a so-called cartridge, in which a photosensitive drum and a developing unit are integrated and exchangeable at once.

Various types of such optical scanning apparatus have been conventionally proposed (see Japanese Patent Application Laid-Open No. 2005-091966).

In the optical scanning apparatus proposed in Japanese Patent Application Laid-Open No. 2005-091966, the optical paths of the imaging optical systems arranged on both sides of the deflector by the reflection mirrors are configured to have arrangements that are different between the imaging optical systems on the right and left of the deflector. This configuration increases the flexibility in arranging the optical paths, so that the optical paths may be folded in sizes of the optical scanning apparatus that are suitable for various color image forming apparatus, to thereby provide an effect that the color image forming apparatus may be downsized.

Meanwhile, in the color image forming apparatus, the frequency at which monochrome images are formed using only the black toner is higher than the frequency at which color images are formed, and hence there is a problem in that only the number of times the black cartridge is exchanged is increased due to the depletion of the black toner or the expiration of the life of the black photosensitive drum.

In order to address the problem, the toner capacity in the black cartridge may be increased, or the diameter of the black photosensitive drum may be increased, to thereby reduce the frequency of exchanging the black cartridge. However, the optical scanning apparatus designed in compliance with the increased size of the cartridge has a longer optical path length. Consequently, when a minimum number of reflection mirrors is to be used to arrange the optical paths, there is a problem in that the optical scanning apparatus is increased in size.

In addition, from the viewpoint of making outer shape of the cartridge of each color uniform, the incident angles of the light beams on the photosensitive drums must be the same, and hence the arrangement of the optical paths in the optical scanning apparatus is severely limited in flexibility. Further, contact surfaces between the photosensitive drum of each color and the conveyer belt must be arranged on line in a sub-scanning section. Therefore, in order to increase only the capacity of the black cartridge, the cartridge is to be increased in size in the parallel arrangement direction or the perpendicular direction of the photosensitive drums while the photosensitive drums remain in the parallel arrangement.

In Japanese Patent Application Laid-Open No. 2005-091966, the black cartridge is placed at the most end position among the cartridges of four colors. In the case where the cartridge capacity is increased in the parallel arrangement direction of the photosensitive drums, the black photosensitive drum is further away from the deflecting unit, to thereby lead to a problem in which the light beam does not reach the photosensitive drum. It is conceivable to move the deflecting unit toward the black photosensitive drum so that the light beam reaches the photosensitive drum. However, this idea is undesirable because decentering the deflecting unit in the optical scanning apparatus results in that the imaging lens of the imaging optical system and the light beam folded by the reflection mirrors interfere more easily. The idea is undesirable also because thermal shift effects are generated asymmetrically on the right and left of the deflecting unit.

In addition, in the case where the black cartridge capacity is increased in the perpendicular direction of the photosensitive drums, the black cartridge intrudes into the optical scanning apparatus, which leads to a problem in which the optical path and the wall surface of the optical scanning apparatus interfere with each other. Otherwise, even in the case where the optical path length is increased in compliance with the increase in the cartridge capacity, unnecessary space is generated between the cartridges other than the black cartridge and the optical scanning apparatus, which leads to an increase in size of the color image forming apparatus.

SUMMARY OF THE INVENTION

It is therefore an object of the present invention to provide an optical scanning apparatus which provides high flexibility in the arrangement of optical paths toward a plurality of photosensitive members and which does not cause an increase in size of a color image forming apparatus even in the case where the cartridge capacity is increased, and to provide a color image forming apparatus using the optical scanning apparatus.

According to an aspect of the present invention, there is provided an image forming apparatus, including; a plurality of light source units, a deflecting unit for deflecting a plurality of light beams emitted from the light source units for scanning, a plurality of photosensitive members for different colors, an imaging optical system for imaging the light beams deflected for scanning by a deflecting surface of the deflecting unit on the photosensitive members, and a plurality of toner containers for the different colors, which are provided for the photosensitive members, respectively, in which the toner containers are different in capacity, and in which an optical path length from the photosensitive member for the same color as the toner container having a large capacity to the deflecting surface of the deflecting unit is longer than an optical path length from the photosensitive member for the same color as the toner container having a small capacity to the deflecting surface of the deflecting unit.

Further, in the image forming apparatus, a dimension of the toner container having the large capacity in a direction perpendicular to a direction in which the toner containers are arrayed is longer than a dimension of the toner container having the small capacity in the direction perpendicular to the direction in which the toner containers are arrayed in a sub-scanning section, intervals among the photosensitive members are equal in the sub-scanning section, and the deflecting unit has a rotational axis that is inclined with respect to the direction perpendicular to the direction in which the toner containers are arrayed in the sub-scanning section.

Further, in the image forming apparatus, the toner containers are arrayed in a direction different from a rotational axis of the deflecting unit in a sub-scanning section, and the toner container having the large capacity is positioned at an end of the toner containers arrayed in the different direction.

Further, in the image forming apparatus, a dimension of the toner container having the large capacity in the direction in which the toner containers are arrayed is longer than a dimension of the toner container having the small capacity in the direction in which the toner containers are arrayed in the sub-scanning section.

Further, in the image forming apparatus, the toner container having the large capacity is for black toner.

According to another aspect of the present invention, there is provided an image forming apparatus, including; a plurality of light source units, a deflecting unit for deflecting a plurality of light beams emitted from the light source units for scanning by different deflecting surfaces, a plurality of photosensitive members for different colors, a plurality of imaging optical systems arranged on each side of the deflecting unit in a sub-scanning section, for imaging the light beams deflected for scanning by the different deflecting surfaces of the deflecting unit on the photosensitive members, and a plurality of toner containers for different colors, which are provided on each side of the deflecting unit in the sub-scanning section for the photosensitive members, respectively, in which the toner containers are different in capacity, and in which an optical path length from the photosensitive member for the same color as the toner container having a large capacity to one of the different deflecting surfaces of the deflecting unit is longer than an optical path length from another the photosensitive member for the same color as the toner container having a small capacity to another one of the different deflecting surfaces of the deflecting unit.

Further, in the image forming apparatus, a dimension of the toner container having the large capacity in a direction perpendicular to a direction in which the toner containers are arrayed is longer than a dimension of the toner container having the small capacity in the direction perpendicular to the direction in which the toner containers are arrayed in the sub-scanning section, intervals among the photosensitive members are equal in the sub-scanning section, and the deflecting unit has a rotational axis that is inclined with respect to the direction perpendicular to the direction in which the toner containers are arrayed in the sub-scanning section.

Further, in the image forming apparatus, the toner containers are arrayed in a direction different from a rotational axis of the deflecting unit in the sub-scanning section, and the toner container having the large capacity is positioned at an end of the toner containers arrayed in the different direction.

Further, in the image forming apparatus, a dimension of the toner container having the large capacity in the direction in which the toner containers are arrayed is longer than a dimension of the toner container having the small capacity in the direction in which the toner containers are arrayed in the sub-scanning section.

Further, in the image forming apparatus, the toner container having the large capacity is for black toner.

According to the present invention, there may be provided an optical scanning apparatus which provides high flexibility in the arrangement of optical paths toward a plurality of photosensitive members and which does not cause an increase in size of a color image forming apparatus even in the case where the cartridge capacity is increased, and also provided a color image forming apparatus using the optical scanning apparatus.

Further features of the present invention will become apparent from the following description of exemplary embodiments with reference to the attached drawings.

DESCRIPTION OF THE EMBODIMENTS

Hereinafter, embodiments of the present invention are described with reference to the accompanying drawings.

First Embodiment

Figure 1:
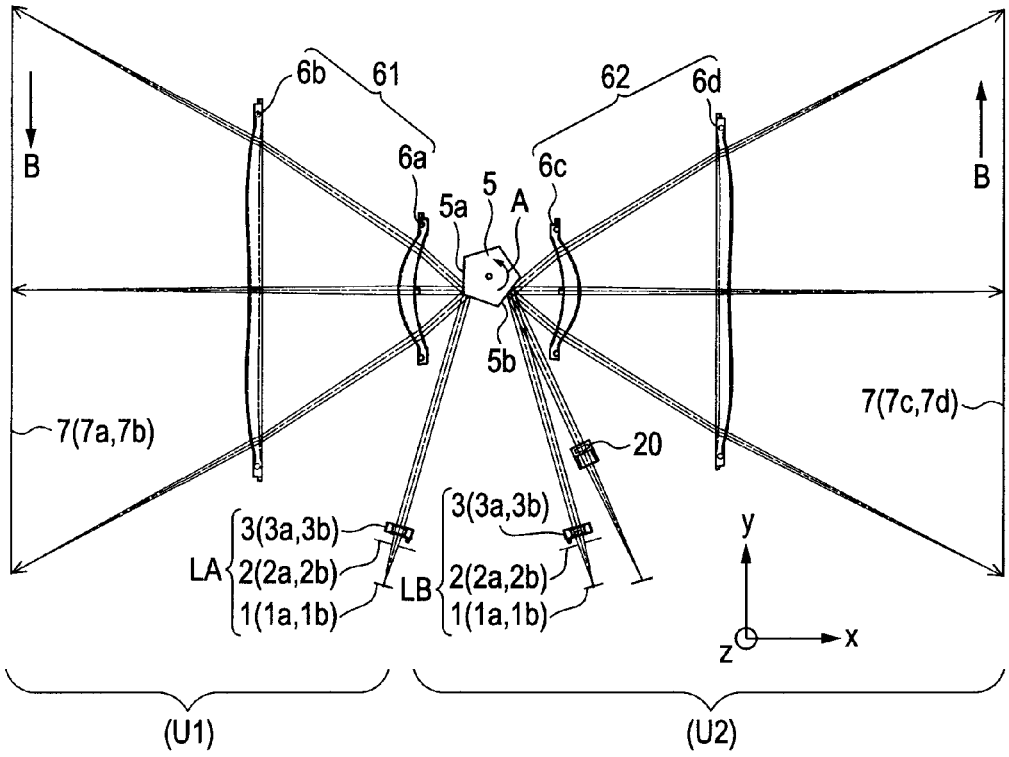
FIG. 1 is a main scanning sectional view of an optical scanning apparatus according to a first embodiment of the present invention.

FIG. 1 is a cross-sectional view of a main portion in a main scanning direction (main scanning sectional view) of an optical scanning apparatus included in an image forming apparatus according to a first embodiment of the present invention, and illustrates an optical path in a developed state.

Note that, in the following description, a sub-scanning direction (Z direction) refers to a direction that is parallel to a rotational axis of a deflecting unit. A main scanning section refers to a cross section having a normal line in the sub-scanning direction (direction that is parallel to the rotational axis of the deflecting unit). The main scanning direction (Y direction) refers to a direction obtained by projecting the light beam deflected for scanning by the deflecting unit on the main scanning section. A sub-scanning section refers to a cross section having a normal line in the main scanning direction.

The image forming apparatus according to the present invention includes a first scanning unit U1, a second scanning unit U2, and a deflecting unit 5 shared between the first and second scanning units. The first scanning unit U1 corresponds to yellow (Y) and magenta (M), and the second scanning unit U2 corresponds to cyan (C) and black (K). The first scanning unit U1 includes a first incident optical system LA and a first imaging optical system, and the second scanning unit U2 includes a second incident optical system LB and a second imaging optical system.

Each of the first incident optical system LA and the second incident optical system LB includes light source units 1*a* and 1*b* each constructed of a semiconductor laser, aperture stops 2*a* and 2*b*, and condenser lenses (anamorphic lenses) 3*a* and 3*b*. The semiconductor laser is driven by a laser unit (not shown) including a laser drive circuit. The aperture stops 2*a* and 2*b* shape a plurality of divergent light beams emitted from the light source units 1*a* and 1*b* into respective specific light beam shapes. The condenser lenses (anamorphic lenses) 3*a* and 3*b* have respective different refractive powers (powers) between the main scanning direction (in main scanning section) and the sub-scanning direction (in sub-scanning section). Thus, the divergent light beams passed through the aperture stops 2*a* and 2*b* are converted into a parallel light beam in the main scanning direction, and into a convergent light beam in the sub-scanning direction.

The incident optical systems LA and LB guide the light beams emitted from the light source units 1*a* and 1*b* to different deflecting surfaces 5*a* and 5*b* of an optical deflector 5 as a deflecting unit to be described below with angles different from one another within the sub-scanning section. The condenser lens 3*a* or 3*b* may be constructed of two optical elements (collimator lens and cylinder lens). Alternatively, the condenser lenses 3*a* and 3*b* may be integrated with each other.

The optical deflector 5 serving as the deflecting unit includes a five-surface polygon optical deflector having a circumcircle of a diameter of 34 mm, and is rotated at a fixed speed (constant angular velocity) in a direction of the arrow A of FIG. 1 by a motor as a driving unit (not shown). Imaging optical systems 61 and 62 (first imaging optical system 61 and second imaging optical system 62) each have a condensing function as an imaging unit and fθ characteristics to be described later. In this embodiment, the imaging optical systems 61 and 62 include first and second imaging lenses (scanning lenses) 6*a* and 6*c*, and 6*b* and 6*d*, respectively, which are imaging optical elements having different powers between the main scanning direction (in main scanning section) and the sub-scanning direction (in sub-scanning section).

In this embodiment, the first and second imaging lenses 6*a* and 6*c*, and 6*b* and 6*d* are made of plastic materials (resins), and image a plurality of light beams based on image information which are deflected by the different deflecting surfaces 5*a* and 5*b* of the optical deflector 5 on corresponding different photosensitive drum surfaces 7*a* and 7*b*, and 7*c* and 7*d* each serving as a surface to be scanned (i.e., on surfaces to be scanned 7*a* and 7*b*, and 7*c* and 7*d*). By setting a conjugate relationship between the deflecting surfaces 5*a* and 5*b* of the optical deflector 5 and the photosensitive drum surfaces 7*a* and 7*b*, and 7*c* and 7*d* in the sub-scanning section, the first and second imaging lenses 6*a* and 6*c*, and 6*b* and 6*d* compensate for surface tilting of the deflecting surfaces 5*a* and 5*b*. The first imaging lenses 6*a* and 6*c* have positive powers in the main scanning and sub-scanning sections on the optical axis of the first imaging lenses 6*a* and 6*c*. The second imaging lenses 6*b* and 6*d* have a negative power in the main scanning section and a positive power in the sub-scanning section on the optical axis of the second imaging lenses 6*b* and 6*d*.

The above-mentioned fθ characteristics mean a relationship where a light beam entering at an angle of field (scanning angle) θ is imaged at a position of $Y=f\times\theta$ on an image plane (i.e., on surface to be scanned 7*a* or 7*b*, or 7*c* or 7*d*), where Y denotes a height from an optical axis and f denotes a constant. In other words, the fθ characteristics mean characteristics where scanning width scanned per unit angle of field (scanning speed) is constant on the entire region of the scanning surface (constant-speed scanning). The constant f is referred to as fθ coefficient. In the case where light beams incident on the imaging optical systems 61 and 62 are parallel light beams, the constant f is equal in value to a paraxial focal length f of each of the imaging optical systems 61 and 62. The photosensitive drum surfaces (photosensitive drums) 7*a* and 7*b*, and 7*c* and 7*d* each function as a surface to be scanned.

Note that, in FIG. 1, a reflection mirror (flat surface mirror) that reflects the optical path is omitted and not illustrated.

In this embodiment, two divergent light beams that have been optically modulated and emitted from the two light source units 1*a* and 1*b* in accordance with the image information are regulated by the corresponding aperture stops 2*a* and 2*b*, and then incident on the condenser lenses 3*a* and 3*b*. The light beams incident on the condenser lenses 3*a* and 3*b* within the main scanning section are formed into parallel light beams and emitted. Further, within the sub-scanning section, the light beams are converged and imaged on the different deflecting surfaces 5*a* and 5*b* of the optical deflector 5 with angles different from each other as linear images (linear images longitudinal in the main scanning direction). Then, the two light beams deflected on the deflecting surfaces 5*a* and 5*b* of the optical deflector 5 are imaged, in spots, on the photosensitive drum surfaces 7*a* and 7*b*, and 7*c* and 7*d* which are different from each other, through the first and second imaging lenses 6*a* and 6*c*, and 6*b* and 6*d*.

Then, the light beam emitted from the light source unit 1*a* enters the deflecting surface of the optical deflector 5 obliquely from above in the sub-scanning section and is reflected obliquely downward. The light beam emitted from the light source unit 1*b* enters the deflecting surface obliquely from below and is reflected obliquely upward.

Then, by rotating the optical deflector 5 in the direction of the arrow A, the photosensitive drum surfaces 7*a* and 7*b*, and 7*c* and 7*d* are optically scanned in a direction of the arrow B (main scanning direction). Thus, an image is recorded on the photosensitive drum surfaces 7*a* and 7*b*, and 7*c* and 7*d* each serving as a recording medium.

In this embodiment, presuming that a printing width equal to an A3 size is scanned, the optical system is configured to have an effective scanning width of 310 mm on the surface to be scanned 7. However, the present invention is not limited thereto, and may be adapted to larger or smaller sizes.

In this embodiment, shapes of refractive surfaces of the first and second imaging lenses 6*a* and 6*b*, and 6*c* and 6*d* are represented by the following shape expressions. Assume that an origin is set at an intersection point with an optical axis, the direction of the optical axis is set as an X-axis, an axis orthogonal to the optical axis within the main scanning surface is set as a Y-axis, and an axis orthogonal to the optical axis within the sub-scanning surface is set as a Z-axis. In this case, a meridian line direction corresponding to the main scanning direction is expressed by the following expression:

$$X = \frac{Y^2/R}{1+\left(1-(1+K)(Y/R)^2\right)^{1/2}} + B_4Y^4 + B_6Y^6 + B_8Y^8 + B_{10}Y^{10} \quad \text{(a)}$$

where R denotes a curvature radius of the meridian line on the optical axis, and K, $B_4$, $B_6$, $B_8$ and $B_{10}$ denote aspherical coefficients.

A sagittal line direction corresponding to the sub-scanning direction (direction including an optical axis, which is orthogonal to the main scanning direction) is expressed by the following expression:

$$S = \frac{Z^2/r'}{1+(1-(Z/r'))^{1/2}} \quad \text{(b)}$$

Here, a curvature radius r' in the sub-scanning direction (sagittal line curvature radius) at a position separated from the optical axis by a distance Y in the main scanning direction is expressed by the following expression:

$$r' = r_0(1+D_2Y^2+D_4Y^4+D_6Y^6+D_8Y^8+D_{10}Y^{10})$$

where $r_0$ denotes the sagittal line curvature radius on the optical axis, and $D_2$, $D_4$, $D_6$, $D_8$, and $D_{10}$ denote coefficients.

The sagittal line curvature radius r' off the optical axis is defined in a plane including a normal line of a meridian line of each position and perpendicular to the main scanning surface. A polynomial expression of the shape expression is expressed by a function up to the tenth order. However, a higher or lower order may also be used. As long as an expression representing a surface shape has equal flexibility in representing the surface, effects of the present invention may be obtained without any problems.

Tables 1 and 2 respectively show an optical arrangement of the optical elements and numerical values of surface shapes of the imaging optical elements (imaging lenses) of the imaging optical system 61 according to the first embodiment.

Aspherical coefficients B4u to B10u and D2u to D10u specify shapes on a side opposite to the light source unit 1 with respect to the optical axis of the lens surface in the main scanning and sub-scanning sections. Aspherical coefficients B41 to B101 and D21 to D101 specify shapes on the side of the light source unit 1 with respect to the optical axis of the lens surface in the main scanning and sub-scanning sections.

In this embodiment, light beams emitted from the light source units 1*a* and 1*b* enter the deflecting surface 5*a* of the optical deflector 5 at an angle with respect to the optical axis of the imaging optical system 61 in the main scanning section. Thus, rotation of the optical deflector 5 is accompanied by a forward and backward movement (sag) of the deflecting surface asymmetrically between a scanning start side and an end side. The asymmetrical sag causes an asymmetrical change in field curvature or in variation of spot diameter in the main scanning direction with respect to the optical axis. In order to excellently compensate for the asymmetrical change, the first and second imaging lenses 6*a* and 6*b* both have surfaces where curvature radiuses of the sub-scanning direction asymmetrically change with respect to the optical axis along the main scanning direction.

In the second, third and fourth surfaces, the aspherical coefficients D2u to D10u and D21 to D101 are different in the sub-scanning section, exhibiting an asymmetrical change in curvature in the sub-scanning section with respect to the optical axis from on-axis to off-axis in an effective diameter of the lens surface.

TABLE 1

| Data on imaging optical system 61 | | |
|---|---|---|
| Oblique incident angle in sub-scanning section (°) | γ | ±3 |
| fθ coefficient (mm/rad) | f | 210 |
| Used wavelength (nm) | λ | 790 |
| Refractive index of scanning lens | N | 1.523972 |
| Maximum deflection angle (°) | θmax | ±42.2 |
| (Deflection point)-(Incident surface of imaging lens 6a) (mm) | D1 | 29.5 |
| (Incident surface of imaging lens 6a)-(Exit surface of imaging lens 6a) (mm) | D2 | 8 |
| (Exit surface of imaging lens 6a)-(Incident surface of imaging lens 6b) (mm) | D3 | 76.0 |
| (Incident surface of imaging lens 6b)-(Exit surface of imaging lens 6b) (mm) | D4 | 5.0 |
| (Exit surface of imaging lens 6b)-(Surface to be scanned) (mm) | D5 | 130.1 |
| (Deflection point)-(Surface to be scanned) (mm) | D | 248.6 |
| Shift amount in sub-scanning section of imaging lens 6b (mm) | s | 1.5 |

TABLE 2

| Data on imaging lens shape | | | | |
|---|---|---|---|---|
| | Imaging lens 6a | | Imaging lens 6b | |
| | Incident surface | Exit surface | Incident surface | Exit surface |
| R | −6.16E+01 | −3.94E+01 | 1.55E+03 | 3.85E+02 |
| K | −8.75E+00 | −2.32E+00 | −3.57E+03 | −1.08E+02 |
| B4u | −1.75E−06 | −2.08E−06 | −3.04E−08 | −2.16E−07 |
| B6u | 3.21E−09 | 1.51E−09 | | 1.74E−11 |
| B8u | −3.26E−12 | −6.25E−13 | | −1.23E−15 |
| B10u | 1.09E−15 | −2.27E−16 | | 3.51E−20 |
| B4l | −1.75E−06 | −2.08E−06 | −3.04E−08 | −2.16E−07 |
| B6l | 3.21E−09 | 1.51E−09 | | 1.74E−11 |
| B8l | −3.26E−12 | −6.25E−13 | | −1.23E−15 |
| B10l | 1.09E−15 | −2.27E−16 | | 3.51E−20 |
| r | 1.20E+02 | −3.80E+01 | 1.95E+02 | −4.78E+01 |
| D2u | | 5.69E−05 | −6.16E−05 | 1.02E−04 |
| D4u | | 1.72E−07 | −5.50E−09 | −1.33E−08 |
| D6u | | | 7.29E−13 | 3.92E−12 |
| D8u | | | −3.80E−17 | −4.75E−16 |
| D10u | | | 1.95E−21 | 4.03E−20 |
| D2l | | 3.53E−05 | −6.16E−05 | 1.02E−04 |
| D4l | | 1.55E−07 | −5.50E−09 | −1.51E−08 |
| D6l | | | 7.29E−13 | 4.30E−12 |
| D8l | | | −3.80E−17 | −5.11E−16 |
| D10l | | | 1.95E−21 | 4.00E−20 |

In this embodiment, the incident surface and the exit surface of the first imaging lens 6*a* have aspherical (noncircular-arc) shapes expressed by a function up to a tenth order in the main scanning section (main scanning direction). In the sub-scanning section (sub-scanning direction), the incident surface thereof has a spherical shape, and the exit surface thereof has a spherical shape where a curvature changes toward the main scanning direction.

The incident surface and the exit surface of the second imaging lens 6*b* have aspherical (noncircular-arc) shapes expressed by a function up to a tenth order in the main scanning section. In the sub-scanning section (sub-scanning direction), the incident surface thereof and the exit surface thereof are both formed into spherical shapes where curvatures change toward the main scanning direction. Reducing power in the sub-scanning section from on-axis to off-axis in the main scanning direction enables fine adjustment of a field curvature in the sub-scanning direction.

In this embodiment, the first and second imaging lenses 6*a* and 6*b* are formed of plastic materials (resins) as described above. However, the materials are not limited to plastic materials, and glass materials may be used.

Figure 2:
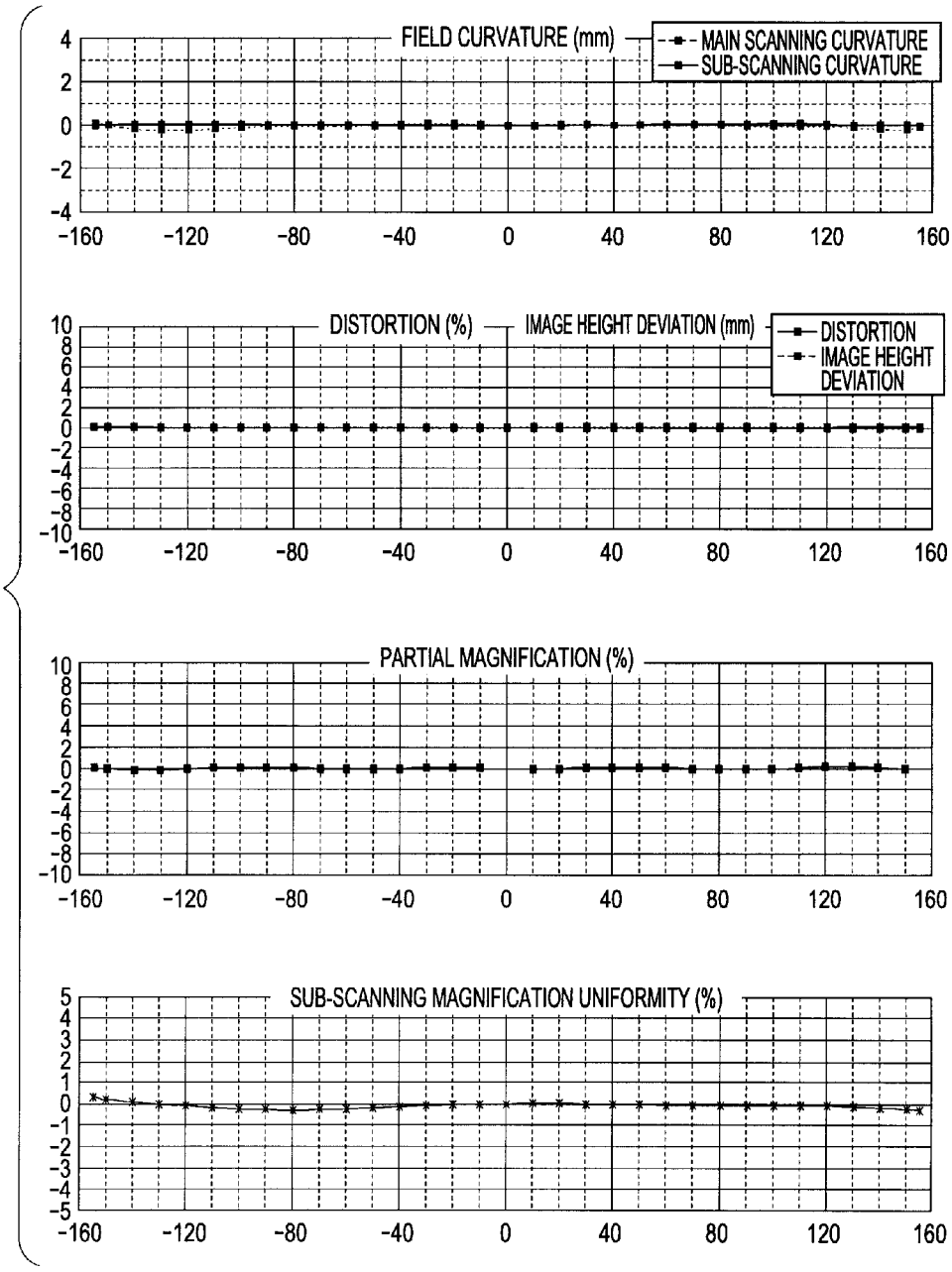
FIG. 2 is a graph showing optical characteristics of an imaging optical system 61 according to the first embodiment of the present invention.

FIG. 2 is a graph showing geometrical aberrations of the imaging optical system 61 according to this embodiment. It can be seen from FIG. 2 that each aberration is adjusted to a level of no practical problem. It can also be seen that a change in magnification in the sub-scanning direction caused by an image height is suppressed to 2% or less. Thus, a change in a spot shape in the sub-scanning direction caused by the image height is suppressed, which attains high imaging performance. A change in magnification in the sub-scanning direction due to the image height may preferably be limited to 10% or less, more preferably 5% or less.

Described hereinafter is the imaging optical system 62 which is designed to have the optical path length from the deflection point to the surface to be scanned which is 20 mm longer than that of the imaging optical system 61 described above.

The imaging optical system 62 is different from the imaging optical system 61 in the fθ coefficient, the maximum deflection angle, the distance between the exit surface of the second imaging lens to the surface to be scanned, the shape of the exit surface of the first imaging lens in the main scanning section, and the shape of the exit surface of the second imaging lens in the sub-scanning section. Other surface shapes and surface intervals are the same as those of the imaging optical system 61.

Tables 3 and 4 respectively show an optical arrangement of optical elements and numerical values of surface shapes of imaging optical elements (imaging lenses) of the imaging optical system 62 according to this embodiment.

TABLE 3

| Data on imaging optical system 62 | | |
|---|---|---|
| Oblique incident angle in sub-scanning section (°) | γ | ±3 |
| fθ coefficient (mm/rad) | f | 230 |
| Used wavelength (nm) | λ | 790 |
| Refractive index of scanning lens | N | 1.523972 |
| Maximum deflection angle (°) | θmax | ±38.6 |
| (Deflection point)-(Incident surface of imaging lens 6c)(mm) | D1 | 29.5 |
| (Incident surface of imaging lens 6c)-(Exit surface of imaging lens 6c) (mm) | D2 | 8 |
| (Exit surface of imaging lens 6c)-(Incident surface of imaging lens 6d) (mm) | D3 | 76.0 |
| (Incident surface of imaging lens 6d)-(Exit surface of imaging lens 6d) (mm) | D4 | 5.0 |
| (Exit surface of imaging lens 6d)-(Surface to be scanned) (mm) | D5 | 150.1 |
| (Deflection point)-(Surface to be scanned) (mm) | D | 268.6 |
| Shift amount in sub-scanning section of imaging lens 6d (mm) | s | 1.5 |

TABLE 4

| Data on imaging lens shape | Imaging lens 6c | | Imaging lens 6d | |
|---|---|---|---|---|
| | Incident surface | Exit surface | Incident surface | Exit surface |
| R | −6.16E+01 | −4.05E+01 | 1.55E+03 | 3.85E+02 |
| K | −8.75E+00 | −2.32E+00 | −3.57E+03 | −1.08E+02 |
| B4u | −1.75E−06 | −1.64E−06 | −3.04E−08 | −2.16E−07 |
| B6u | 3.21E−09 | 1.42E−09 | | 1.74E−11 |
| B8u | −3.26E−12 | −6.53E−13 | | −1.23E−15 |
| B10u | 1.09E−15 | −1.70E−16 | | 3.51E−20 |
| B4l | −1.75E−06 | −1.64E−06 | −3.04E−08 | −2.16E−07 |
| B6l | 3.21E−09 | 1.42E−09 | | 1.74E−11 |
| B8l | −3.26E−12 | −6.53E−13 | | −1.23E−15 |
| B10l | 1.09E−15 | −1.70E−16 | | 3.51E−20 |
| r | 1.20E+02 | −3.80E+01 | 1.95E+02 | −5.27E+01 |
| D2u | | 5.69E−05 | −6.16E−05 | 1.05E−04 |
| D4u | | 1.72E−07 | −5.50E−09 | −1.21E−08 |
| D6u | | | 7.29E−13 | 3.94E−12 |
| D8u | | | −3.80E−17 | −5.17E−16 |
| D10u | | | 1.95E−21 | 4.97E−20 |
| D2l | | 3.53E−05 | −6.16E−05 | 1.06E−04 |
| D4l | | 1.55E−07 | −5.50E−09 | −1.56E−08 |
| D6l | | | 7.29E−13 | 4.99E−12 |
| D8l | | | −3.80E−17 | −6.60E−16 |
| D10l | | | 1.95E−21 | 5.49E−20 |

Figure 3:
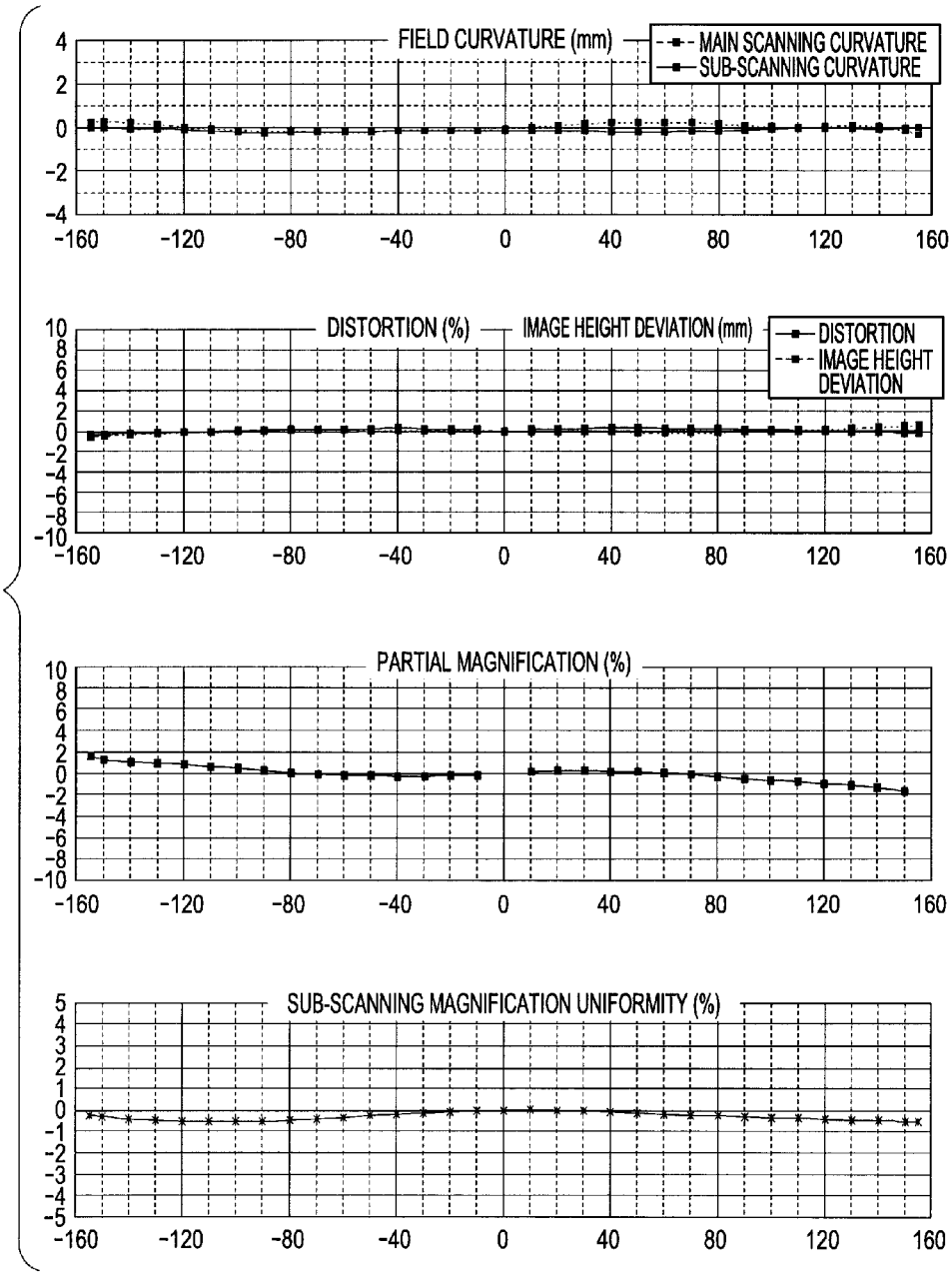
FIG. 3 is a graph showing optical characteristics of an imaging optical system 62 according to the first embodiment of the present invention.

FIG. 3 is a graph showing geometrical aberrations of the imaging optical system 62 according to this embodiment. It can be seen from FIG. 3 that each aberration is adjusted to a level of no practical problem. It can also be seen that a change in magnification in the sub-scanning direction caused by an image height is suppressed to 2% or less.

Figure 4:
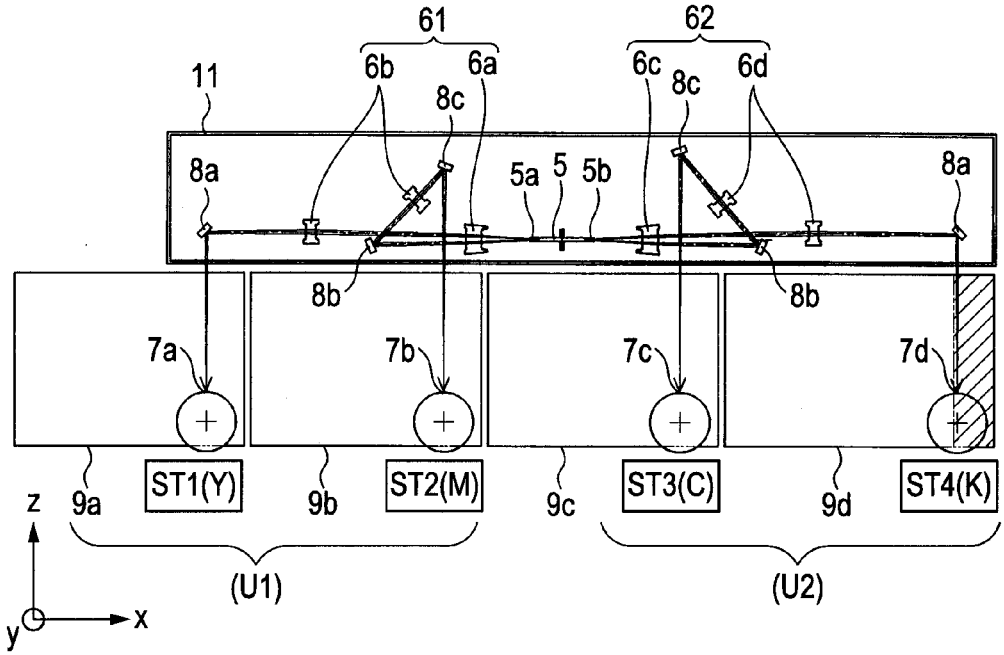
FIG. 4 is a sub-scanning sectional view of the optical scanning apparatus according to the first embodiment of the present invention.

Referring to FIG. 4, means for achieving objects and effects of this embodiment are described.

FIG. 4 is a cross-sectional view of a main portion in the sub-scanning direction (sub-scanning sectional view) in which reflection mirrors are arranged in the optical scanning apparatus illustrated in FIG. 1. In FIG. 4, the same elements as those illustrated in FIG. 1 are denoted by the same reference symbols. In FIG. 4, the image forming apparatus includes: an optical scanning apparatus 11; a first scanning unit (optical scanning apparatus) U1 including an incident optical system LA, an optical deflector 5 and an imaging optical system 61; and a second scanning unit U2 including an incident optical system LB, the optical deflector 5, and an imaging optical system 62. Further, the first scanning unit U1 includes two stations ST1 and ST2 for yellow (Y) and magenta (M), and the second scanning unit U2 includes two stations ST3 and ST4 for cyan (C) and black (K).

Note that, the first and second scanning units U1 and U2 are different in configuration but identical in optical action, and hence the following description is mainly directed to the first scanning unit U1. The same members of the second scanning unit U2 as those of the first scanning unit U1 are denoted by the same reference symbols.

Photosensitive drums (surfaces to be scanned) 7*a*, 7*b*, 7*c* and 7*d* serving as recording mediums are photosensitive drums serving as recording mediums for yellow (Y), magenta (M), cyan (C) and black (K), respectively. Reflection mirrors 8*a*, 8*b* and 8*c* serving as light beam reflection units consist of plane mirrors, and fold light beams that have passed through first and second imaging lenses 6*a* and 6*c*, and 6*b* and 6*d* toward the corresponding photosensitive drums 7*a*, 7*b*, 7*c* and 7*d*, respectively. Note that, each of the reflection mirrors 8*a*, 8*b* and 8*c* may have a power in the main scanning section or in the sub-scanning section. In addition, by setting appropriate optical path lengths for the array of the photosensitive drums, one reflection mirror is provided for guiding the scanning light beam to each of yellow and black photosensitive drums, to thereby contribute to reductions in size and cost of the optical scanning apparatus.

The optical deflector (rotational polygon mirror) 5 serving as the deflecting unit is shared among the first, second, third and fourth stations ST1, ST2, ST3 and ST4. A so-called opposing optical scanning apparatus is adopted in which two stations are distributed symmetrically on each side of a rotational axis of the optical deflector 5. In this way, the optical scanning apparatus has a configuration that can be mounted in a color image forming apparatus using four colors (Y, M, C and K).

Y, M, C and K toner cartridges 9*a*, 9*b*, 9*c* and 9*d* have the photosensitive drums 7*a*, 7*b*, 7*c* and 7*d*, respectively, and each also have a charging unit, a developing unit, and a cleaning unit, all of which are not illustrated. Those units are integrally incorporated in a cartridge container to form a cartridge, and are detachably attachable to the color image forming apparatus. The developing unit contains toner, and the cartridge is to be replaced by a new toner cartridge when the toner is depleted.

In the color image forming apparatus according to this embodiment, in order to lengthen the exchange cycle of the black toner cartridge, the toner capacity of the black toner cartridge is increased from those of the toner cartridges of other colors by the dimension indicated by the hatched portion in FIG. 4. Therefore, the black photosensitive drum is positioned further away from the deflector (at the end of the parallel arrangement), and the interval from the adjacent photosensitive drum is longer than the intervals between the other photosensitive drums. Accordingly, in this embodiment, the optical path length from the deflection point of the second scanning unit U2 on the black side to the surface to be scanned is designed to be longer than that of the first scanning unit U1 by 20 mm. This allows the light beam to be guided to the black photosensitive member without decentering the deflector in the optical scanning apparatus. Note that, the optical path for cyan is also lengthened by 20 mm, but this does not have a problem when routing of the optical path by the reflection mirrors is appropriately set so as not to cause enlargement of the optical scanning apparatus.

Note that, in this embodiment, the fθ coefficient of the imaging optical system is varied to change the optical path length for each scanning unit, and hence the scanning speed of the light beam on the surface to be scanned also varies between the first scanning unit U1 and the second scanning unit U2. Therefore, the frequency of an image clock signal is varied for each scanning unit, so that color shift does not occur in the main scanning direction on the surface to be scanned.

An example of a data clock generating circuit, which generates a data clock signal as a reference emission timing from the light source units for synchronizing pixels (dots) on the surface to be scanned, is described. The data clock generating circuit is provided in a printer controller 53 of the color image forming apparatus, which is described below.

Figure 5:
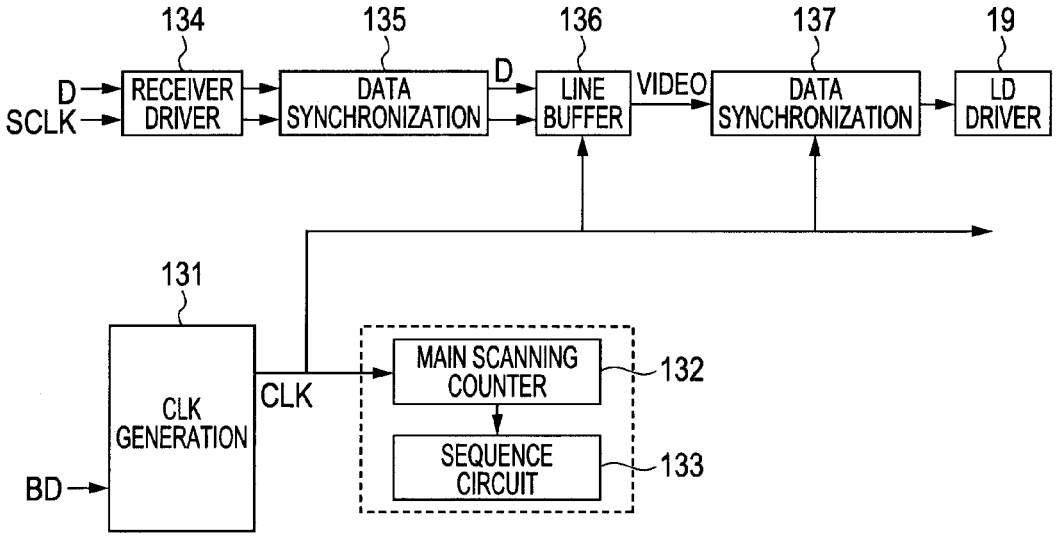
FIG. 5 is a block diagram illustrating an example of an image data control circuit.
Figure 6:
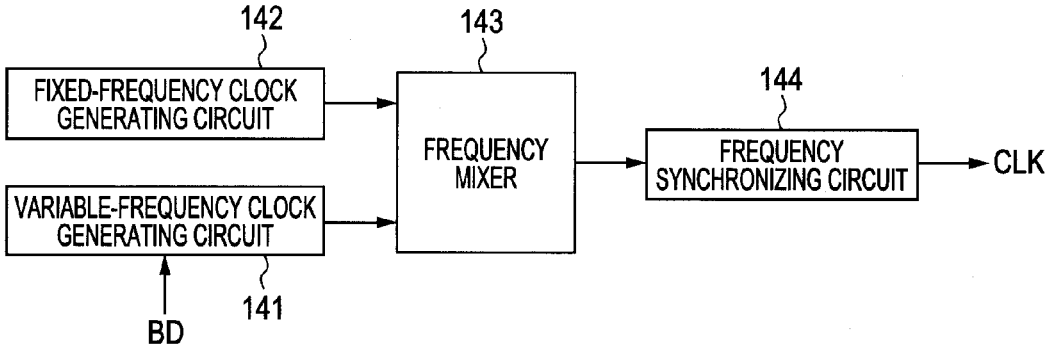
FIG. 6 is a block diagram illustrating an example of a data clock generating circuit.
Figure 7:
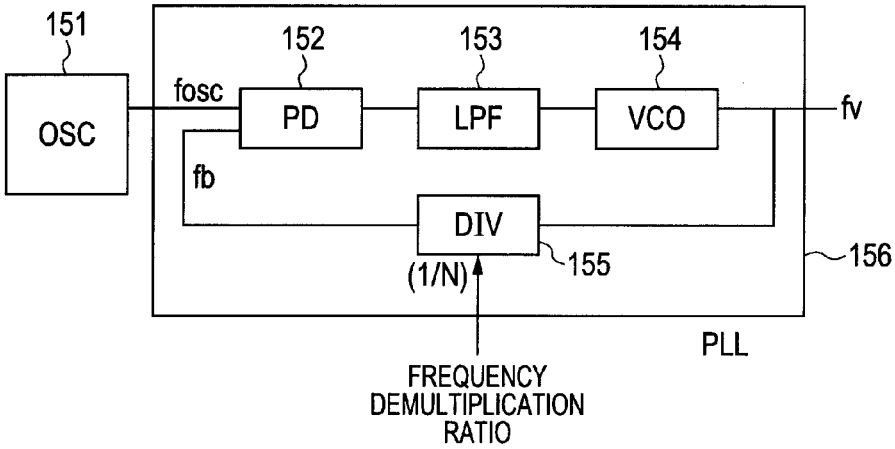
FIG. 7 is a block diagram illustrating an example of a phase lock loop (PLL).

FIG. 5 is a block diagram of an image data control circuit (control unit) of the image forming apparatus, FIG. 6 is a block diagram of the data clock generating circuit of the control circuit, and FIG. 7 is an example of a block diagram of a phase lock loop (PLL) constituting a variable-frequency clock generating circuit of the data clock generating circuit.

An example of the data clock generating circuit includes a fixed-frequency clock generating circuit for generating a fixed-frequency clock signal, a variable-frequency clock generating circuit for generating a variable-frequency clock signal, and a frequency mixer for mixing frequencies of the clock signals from the fixed clock generating circuit and the variable-frequency clock generating circuit, and the frequency of the clock signal generated from the fixed-frequency clock generating circuit needs to be matched with the optical path length from the semiconductor laser to each of the photosensitive drums.

The above-mentioned data clock generating circuit generates a clock signal obtained by mixing the frequencies of the fixed-frequency clock signal and the variable-frequency clock signal. As the optical path length from the semiconductor laser to the photosensitive drums becomes longer, the frequency of the fixed-frequency clock signal also becomes higher, and hence the frequency of the variable-frequency clock signal is changed to adjust the scanning length of one line to be scanned on the surface of the photosensitive drum.

Referring to FIG. 5, an example of the image data control circuit of the image forming apparatus is described. A light beam detection signal BD from a photosensor (not shown) provided to match dot phases among scanning lines is input to a data clock generating circuit 131, and a coherent data clock signal CLK is output. The data clock signal CLK is input to a main scanning counter 132, and the dot address is determined. In a main scanning sequence, a main scanning sequence circuit 133 performs overall control of scanning of one line.

Further, image data D is input to a data synchronizing circuit 135 via a receiver driver 134, and is read into a line buffer memory 136 in synchronization with an image clock signal SCLK, which is also input to the data synchronizing circuit 135 via the receiver driver 134 from an external device. The data clock signal CLK is also input to the line buffer memory 136 and a data synchronizing circuit 137 to provide a synchronization timing in writing the image data. Image data VIDEO output from the data synchronizing circuit 137 in synchronization with the data clock signal CLK is supplied to a laser drive circuit 19. The laser drive circuit 19 turns the semiconductor laser on and off in accordance with the image data VIDEO. The light beam emitted from the semiconductor laser irradiates the photosensitive drums to form a latent image of a recorded image.

In the above-mentioned image data control circuit, the frequency of the data clock signal CLK output from the data clock generating circuit 131 is changed to change the dot density in the main scanning direction. In other words, the deflection magnification in the main scanning direction may be controlled by the frequency of the data clock signal CLK.

FIG. 6 illustrates an example of the above-mentioned data clock generating circuit 131, which includes a variable-frequency clock generating circuit 141, a fixed-frequency clock generating circuit 142 and a frequency mixer 143 for outputting a clock signal generated by mixing frequencies of clock signals output from the variable-frequency clock generating circuit 141 and the fixed-frequency clock generating circuit 142. In the case where the frequencies of the clock signals output from the variable-frequency clock generating circuit 141 and the fixed-frequency clock generating circuit 142 are represented by fv and fs, respectively, the frequency mixer 143, to which the clock signals are input, outputs the clock signal having the frequency f=fv+fs.

The variable-frequency clock generating circuit 141 and the fixed-frequency clock generating circuit 142 described above may be constituted of, for example, a quartz oscillator and a PLL.

An example of the PLL has a circuit configuration as illustrated in the block diagram of FIG. 7. A clock signal having a frequency fosc, which is output from an oscillator (OSC) 151, is input to a phase comparator (PD) 152 and compared in phase with an output feedback signal fb of a PLL 156 input through a frequency demultiplier (DIV) 155. The comparison output from the PD 152 is supplied to a voltage-controlled variable oscillator (VCO) 154 through a low-pass filter (LPF) 153. The VCO 154 outputs an oscillation signal having a frequency depending on the comparison. The PLL 156 operates so as to eliminate the frequency difference and the phase difference between the oscillation clock signal having the frequency fosc and the output feedback signal frequency-demultiplied into 1/N by the DIV 155, and outputs a stable clock signal having the frequency fv=fosc×N. The frequency demultiplication ratio N input to the DIV 155 may be arbitrarily selected, so that the output clock signal fv has an arbitrary frequency.

With the above-mentioned configuration, even in the case where the optical path lengths are different, the frequency of the image clock signal may be changed for each scanning unit by providing an image clock generating circuit.

Figure 8:
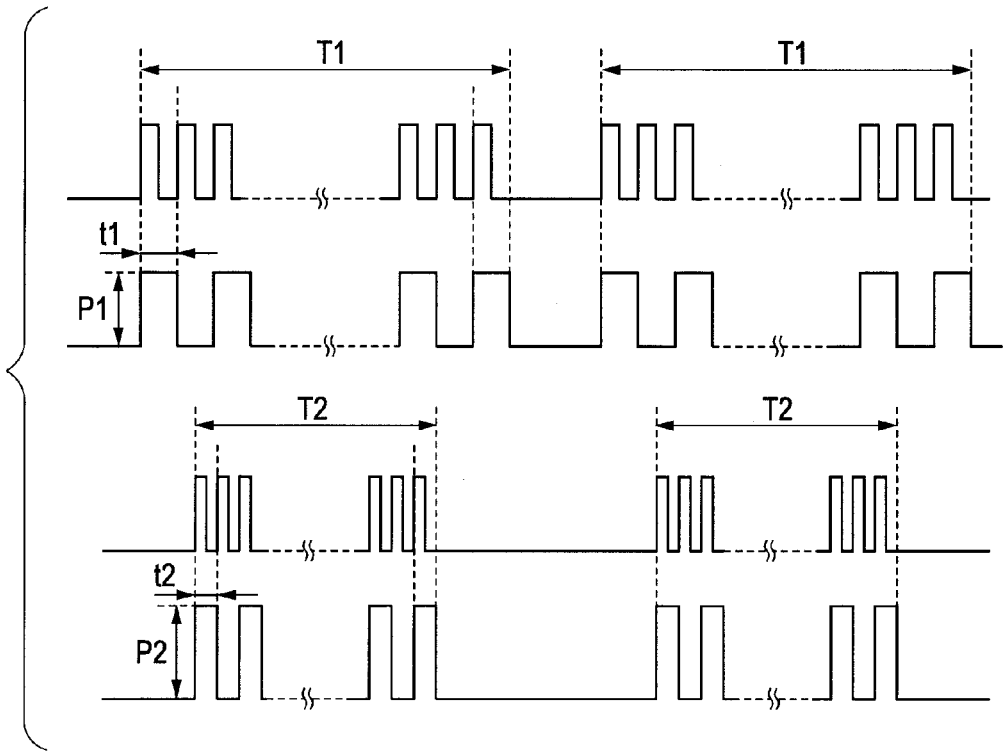
FIG. 8 is a timing chart illustrating modulation methods in scanning units having different optical path lengths.

Referring to FIG. 8, a method of modulating the image clock signal in the scanning units having different optical path lengths is described. Each of the image clock signals is corrected while maintaining the following relationships:

$$T1/T2=f2/f1,$$

where f1 denotes the fθ coefficient of the first scanning unit U1 (first fθ coefficient), f2 denotes the fθ coefficient of the second scanning unit U2 (second fθ coefficient), T1 denotes the time period required for outputting image signals of one line to the photosensitive drums 7*a* and 7*b*, and T2 denotes the time period required for outputting image signals of one line to the photosensitive drums 7*c* and 7*d*; and $$W1/W2=f1/f2,$$

where W1 denotes the clock frequency as a reference pixel switching timing of the image signal for the photosensitive drums 7*a* and 7*b* (first clock frequency), and W2 denotes the clock frequency for the photosensitive drums 7*c* and 7*d* (second clock frequency), to thereby correct the image data VIDEO which is an input signal to the laser drive circuit 19.

With the above-mentioned correction, even in the case where the optical path lengths are different and hence the scanning speeds of the light beams on the photosensitive drums 7*a*, 7*b*, 7*c* and 7*d* are different, the dot densities (pixel densities) on the photosensitive drums 7*a*, 7*b*, 7*c* and 7*d* may be set equal to each other.

Further, the light beam density (energy) of one dot on photosensitive drums may be matched by setting output light beam amounts Lp1 and Lp2 of a light beam modulator (laser driver circuit 19) so as to maintain the relationship:

$$P1\times t1=P2\times t2,$$

where t1 denotes one period (time period for one pixel) for the clock frequency W1 as the reference pixel switching timing of the image signal, t2 denotes one period (time period for one pixel) for the clock frequency W2, P1 denotes a photosensitive drum surface light beam amount of the light beams on the photosensitive drums 7*a* and 7*b*, and P2 denotes a photosensitive drum surface light beam amount of the light beams on the photosensitive drums 7*c* and 7*d*. This way, an amount of the latent image per dot on the drum in the electrophotographic process may be set equal among the drums. At this time, the output light beam amounts Lp1 and Lp2 of the semiconductor laser are set in consideration of the transmittance of the lens, the reflectance of the mirror, and the like.

With the above-mentioned settings, even in the case where the optical path lengths are different and hence the scanning speeds of the light beams on the photosensitive drums 7*a*, 7*b*, 7*c* and 7*d* are different, the dot densities on the photosensitive drums 7*a*, 7*b*, 7*c* and 7*d* may be set equal to each other. Also, the amount of the latent image per dot may be set equal by adjusting the amount of respective light beams, to thereby prevent image deterioration due to the difference in the image clock signal and the difference in the amount of the latent image due to the difference in the scanning speed.

In the present invention, the following condition is satisfied:

$$1.03\leqq Lmax/Lmin\leqq 1.20 \quad (1)$$

where, of the optical path lengths from the deflection points of the imaging optical systems distributed on each side of the deflecting unit to the surface to be scanned, Lmin denotes the shorter optical path length and Lmax denotes the longer optical path length.

When Lmax/Lmin exceeds the upper limit of the conditional expression (1), in order that the first scanning unit U1 and the second scanning unit U2 may have different optical path lengths, the imaging lenses of the imaging optical system 61 and the imaging optical system 62 need to have surface shapes significantly different from each other. In that case, the imaging lenses have significantly different profiles of the eccentric sensitivity, which is undesirable because higher-order color misregistration remains on the surface to be scanned even when the eccentric tolerance is suppressed as much as possible at the time of assembly of the optical scanning apparatus. When Lmax/Lmin is smaller than the lower limit of the conditional expression (1), on the other hand, adaptation to increase the capacity of a particular cartridge becomes impossible, which is undesirable.

In this embodiment, of the optical path lengths from the deflection points of the imaging optical systems distributed on each side of the deflecting unit to the surface to be scanned, the shorter optical path length Lmin and the longer optical path length Lmax are set as follows:

$$Lmin=248.6\ (mm);and$$

$$Lmax=268.6\ (mm).$$

When these values are applied to the conditional expression (1), the following equation is obtained:
$1.03\leqq 1.08\leqq 1.20$,
which satisfies the conditional expression (1).

It is more preferred when the numerical range of the conditional expression (1) is set as follows:

$$1.05\leqq Lmax/Lmin\leqq 1.10 \quad (1a).$$

Further, in comparison to the maximum deflection angle ±42.2° of the first scanning unit U1 having the short optical path length, the maximum deflection angle of the second scanning unit U2 having the long optical path length is as small as ±38.6°. Therefore, a light beam detecting optical system (BD optical system) such as a BD lens 20 for performing scanning synchronization detection in the main scanning direction is positioned in an empty space on the second scanning unit U2 side as illustrated in FIG. 1, so that the space may be utilized effectively.

As described above, in this embodiment, the optical path to a plurality of photosensitive members may be routed with high flexibility, and there may be obtained the optical scanning apparatus which does not cause enlargement of the color image forming apparatus even if the cartridge capacity is increased, and a color image forming apparatus using the optical scanning apparatus.

Note that, in this embodiment, each of the light source units 1*a* and 1*b* is constituted of a single light-emitting part. However, the present invention is not limited thereto, and the each of the light source units 1*a* and 1*b* may be constituted of a plurality of light-emitting parts. Further, in this embodiment, each of the imaging optical systems 61 and 62 is constituted of two imaging lenses. However, the present invention is not limited thereto, and the each of the imaging optical systems 61 and 62 may be constituted of one imaging lens or two or more imaging lenses.

Second Embodiment

Hereinafter, a second embodiment of the present invention is described.

This embodiment is different from the above-mentioned first embodiment in that, of the imaging optical elements as the imaging optical systems distributed on each side of the deflecting unit, the surface shapes of the imaging optical elements positioned closest to the surface to be scanned are the same. Other configurations and optical actions are similar to those of the first embodiment, to thereby obtain the effects similar to those of the first embodiment.

Table 5 shows numerical values of surface shapes of imaging optical elements (first imaging lens 6*e* and second imaging lens 6*b*) constituting an imaging optical system 63 of a second scanning unit U3 according to this embodiment.

TABLE 5

Data on imaging lens shape

| | Imaging lens 6e | | Imaging lens 6b | |
|---|---|---|---|---|
| | Incident surface | Exit surface | Incident surface | Exit surface |
| R | −6.16E+01 | −4.05E+01 | 1.55E+03 | 3.85E+02 |
| K | −8.75E+00 | −2.29E+00 | −3.57E+03 | −1.08E+02 |
| B4u | −1.75E−06 | −1.57E−06 | −3.04E−08 | −2.16E−07 |
| B6u | 3.21E−09 | 1.35E−09 | | 1.74E−11 |
| B8u | −3.26E−12 | −5.99E−13 | | −1.23E−15 |
| B10u | 1.09E−15 | −1.87E−16 | | 3.51E−20 |
| B4l | −1.75E−06 | −1.57E−06 | −3.04E−08 | −2.16E−07 |
| B6l | 3.21E−09 | 1.35E−09 | | 1.74E−11 |
| B8l | −3.26E−12 | −5.99E−13 | | −1.23E−15 |
| B10l | 1.09E−15 | −1.87E−16 | | 3.51E−20 |
| r | 1.20E+02 | −5.49E+01 | 1.95E+02 | −4.78E+01 |
| D2u | | 2.17E−04 | −6.16E−05 | 1.02E−04 |
| D4u | | 2.13E−07 | −5.50E−09 | −1.33E−08 |
| D6u | | | 7.29E−13 | 3.92E−12 |
| D8u | | | −3.80E−17 | −4.75E−16 |
| D10u | | | 1.95E−21 | 4.03E−20 |
| D2l | | 2.12E−04 | −6.16E−05 | 1.02E−04 |
| D4l | | 2.18E−07 | −5.50E−09 | −1.51E−08 |
| D6l | | | 7.29E−13 | 4.30E−12 |
| D8l | | | −3.80E−17 | −5.11E−16 |
| D10l | | | 1.95E−21 | 4.00E−20 |

As shown in Table 5 above, the imaging optical element 6*b* (Table 2) positioned closest to the surface to be scanned in the first scanning unit U1 according to the first embodiment is used as the imaging optical element positioned closest to the surface to be scanned in the first and second scanning units U1 and U3 according to this embodiment.

Figure 9:
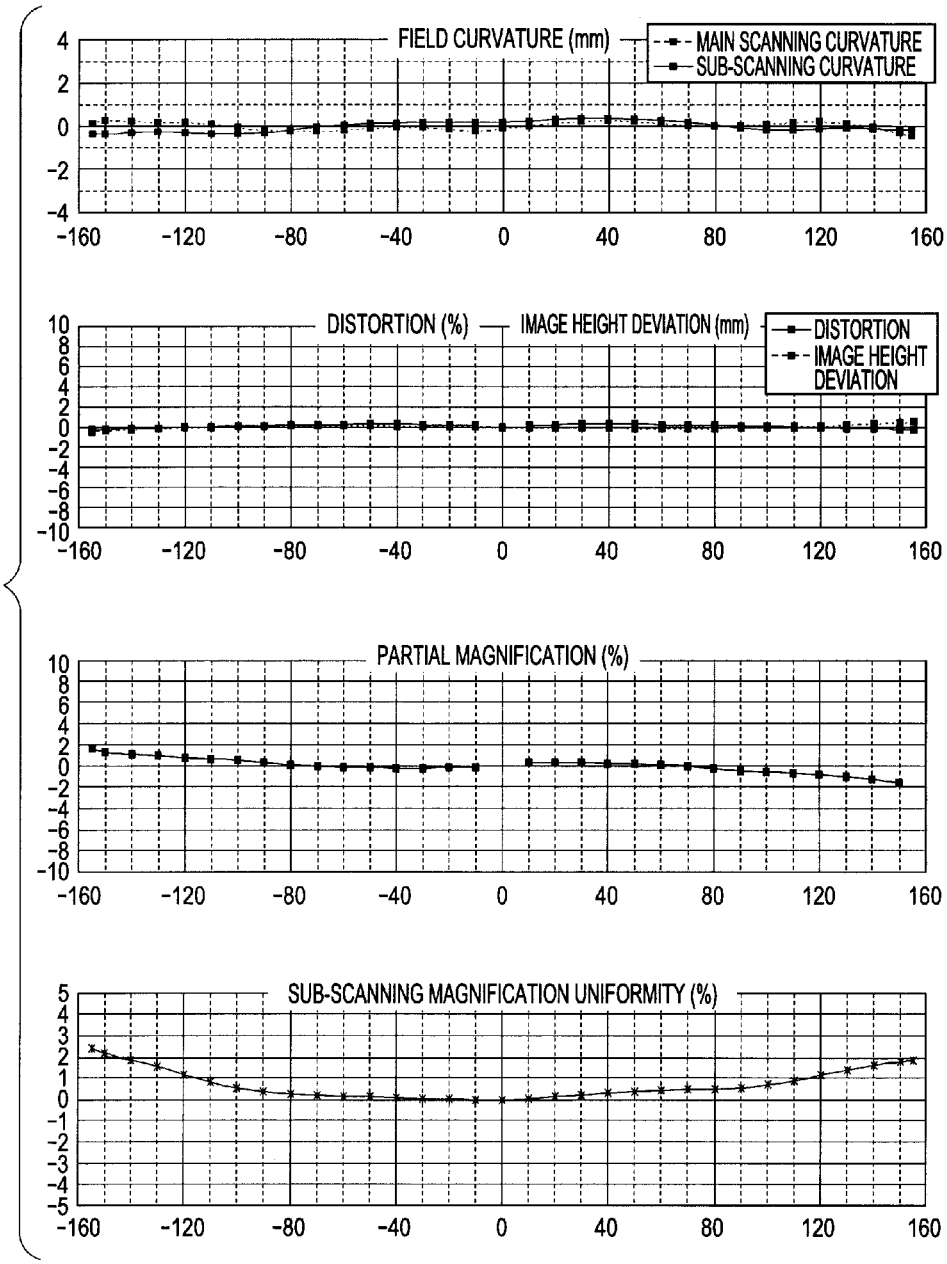
FIG. 9 is a graph showing optical characteristics of an imaging optical system 63 according to a second embodiment of the present invention.

FIG. 9 is a graph showing geometrical aberrations of the imaging optical system 63 according to this embodiment. It can be seen from FIG. 9 that each aberration is adjusted to a level of no practical problem. It can also be seen that a change in magnification in the sub-scanning direction caused by an image height is suppressed to 3% or less.

Figure 10:
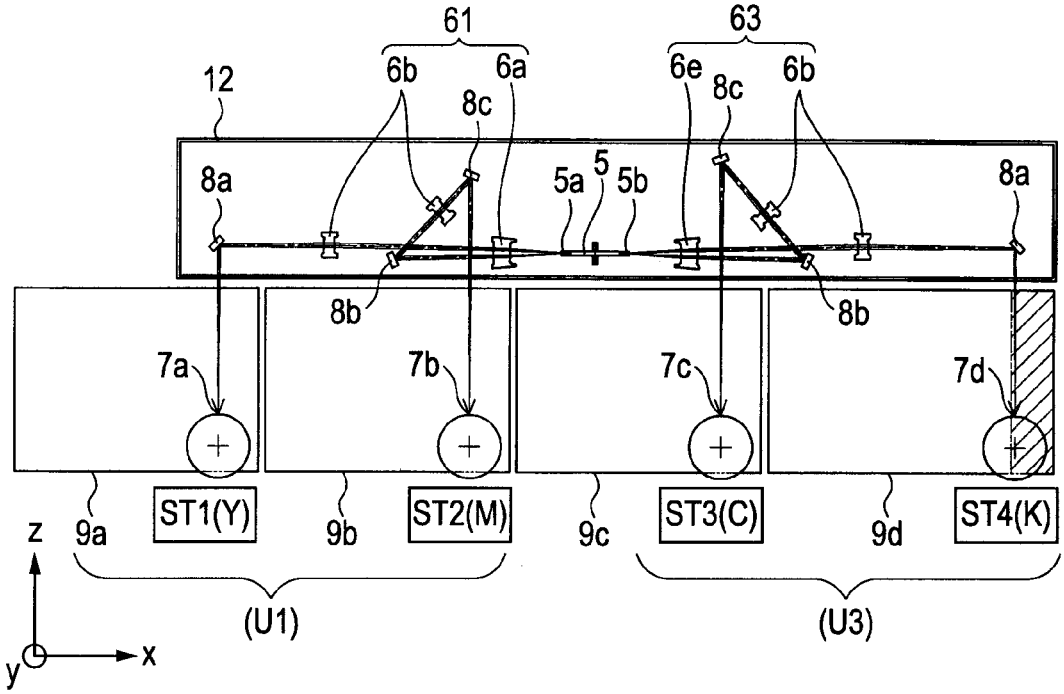
FIG. 10 is a sub-scanning sectional view of an optical scanning apparatus according to the second embodiment of the present invention.

FIG. 10 is a cross-sectional view of a main portion in the sub-scanning direction (sub-scanning sectional view) of an optical scanning apparatus according to this embodiment. In FIG. 10, the same elements as those illustrated in FIG. 4 are denoted by the same reference symbols.

In this embodiment, scanning light beams are guided by the first scanning unit U1 to the stations ST1 and ST2 and by the second scanning unit U3 to the stations ST3 and ST4. Further, the surface shapes of the second imaging lenses (imaging lenses closer to the surface to be scanned) of the first scanning unit U1 and the second scanning unit U2 are set the same. This reduces the number of lens forming molds and the types of the lens, which leads to a decrease in chances of wrong assembly into an optical box.

Third Embodiment

Hereinafter, a third embodiment of the present invention is described.

This embodiment is different from the above-mentioned first embodiment in that a light beam entering a deflecting unit of a second scanning unit U4 is divergent light beam in the main scanning section. In other words, the light beam entering the deflecting unit of the first scanning unit and the light beam entering the deflecting unit of the second scanning unit have different degrees of convergence in the main scanning section. Other configurations and optical actions are similar to those of the first embodiment, to thereby obtain the effects similar to those of the first embodiment.

The degree of convergence m may be expressed as:

$$m=1-Sk/f,$$

where Sk is a distance from the rear principal plane of the imaging optical system to the surface to be scanned in the main scanning section (mm), and f is a focal length in the main scanning section of the imaging optical system (mm).

Further, values of m may be categorized into the following three cases:

When m=0, parallel light beam enters the deflecting unit in the main scanning direction;

When m<0, divergent light beam enters the deflecting unit in the main scanning direction; and When m>0, convergent light beam enters the deflecting unit in the main scanning direction.

In this embodiment, the parallel light beam enters the deflecting unit because the degree of convergence m of the first scanning unit is 0, and the divergent light beam enters the deflecting unit because the degree of convergence m of the second scanning unit is 0.56.

Table 6 shows numerical values of surface shapes of imaging optical elements (first imaging lens 6*f* and second imaging lens 6*g*) constituting an imaging optical system 64 of the second scanning unit U4 according to this embodiment.

TABLE 6

Data on imaging lens shape

| | Imaging lens 6f | | Imaging lens 6g | |
|---|---|---|---|---|
| | Incident surface | Exit surface | Incident surface | Exit surface |
| R | −6.16E+01 | −3.47E+01 | 1.55E+03 | 3.85E+02 |
| K | −8.75E+00 | −9.27E−01 | −3.57E+03 | −1.08E+02 |
| B4u | −1.75E−06 | −4.23E−08 | −3.04E−08 | −2.16E−07 |
| B6u | 3.21E−09 | 2.48E−10 | | 1.74E−11 |
| B8u | −3.26E−12 | 4.50E−13 | | −1.23E−15 |
| B10u | 1.09E−15 | −8.88E−16 | | 3.51E−20 |
| B4l | −1.75E−06 | −4.23E−08 | −3.04E−08 | −2.16E−07 |
| B6l | 3.21E−09 | 2.48E−10 | | 1.74E−11 |
| B8l | −3.26E−12 | 4.50E−13 | | −1.23E−15 |
| B10l | 1.09E−15 | −8.88E−16 | | 3.51E−20 |
| r | 1.20E+02 | −5.49E+01 | 1.95E+02 | −5.27E+01 |
| D2u | | 2.17E−04 | −6.16E−05 | 1.06E−04 |
| D4u | | 2.13E−07 | −5.50E−09 | −2.06E−08 |
| D6u | | | 7.29E−13 | 7.81E−12 |

TABLE 6-continued

| Data on imaging lens shape | | | | |
|---|---|---|---|---|
| | Imaging lens 6f | | Imaging lens 6g | |
| | Incident surface | Exit surface | Incident surface | Exit surface |
| D8u | | | −3.80E−17 | −1.22E−15 |
| D10u | | | 1.95E−21 | 9.35E−20 |
| D2l | | 2.12E−04 | −6.16E−05 | 1.01E−04 |
| D4l | | 2.18E−07 | −5.50E−09 | −1.56E−08 |
| D6l | | | 7.29E−13 | 5.06E−12 |
| D8l | | | −3.80E−17 | −6.78E−16 |
| D10l | | | 1.95E−21 | 5.50E−20 |

Figure 11:
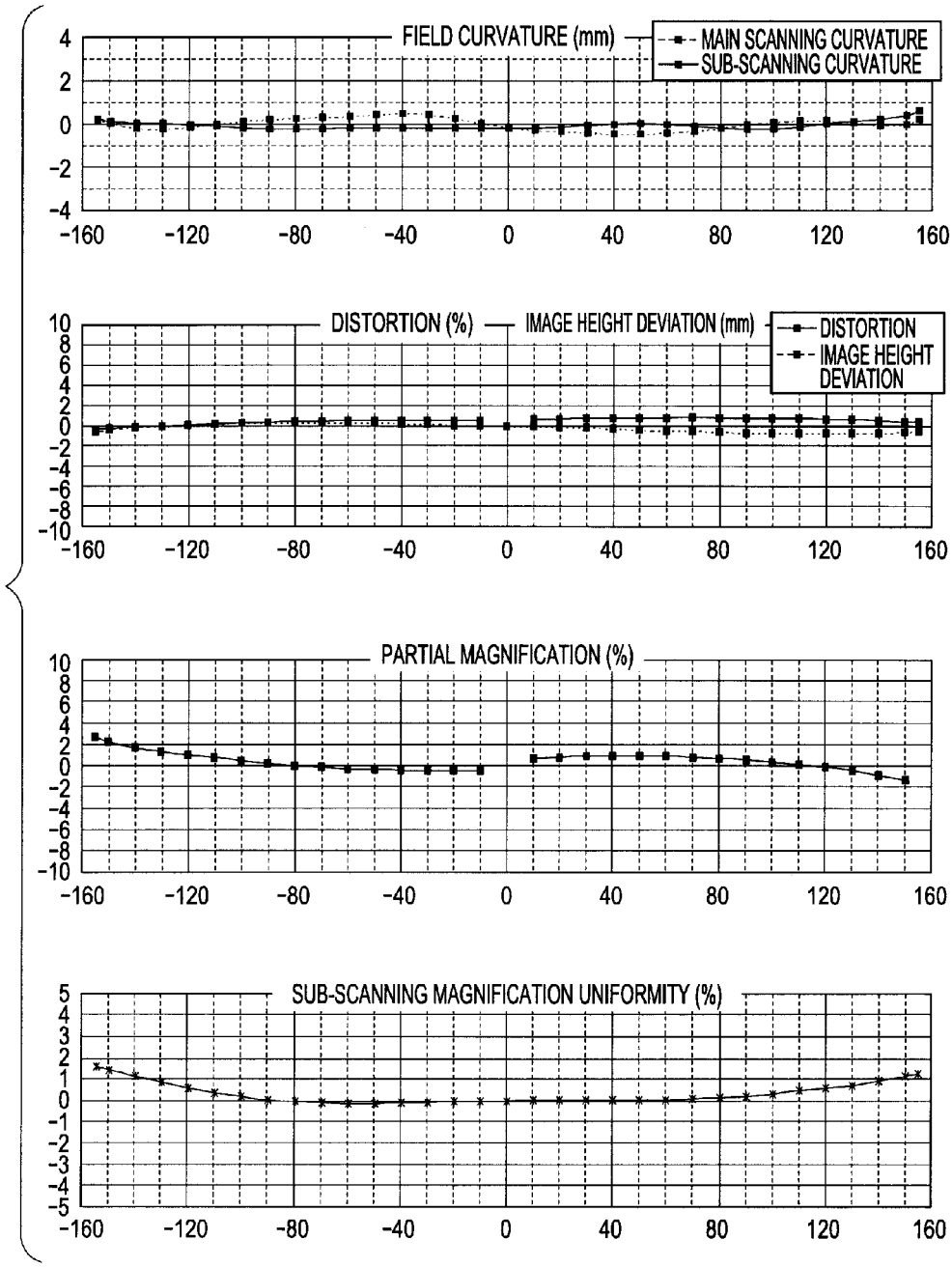
FIG. 11 is a graph showing optical characteristics of an imaging optical system 64 according to a third embodiment of the present invention.

FIG. 11 is a graph showing geometrical aberrations of the imaging optical system 64 according to this embodiment. It can be seen from FIG. 11 that each aberration is adjusted to a level of no practical problem. It can also be seen that a change in magnification in the sub-scanning direction caused by an image height is suppressed to 2% or less.

Figure 12:
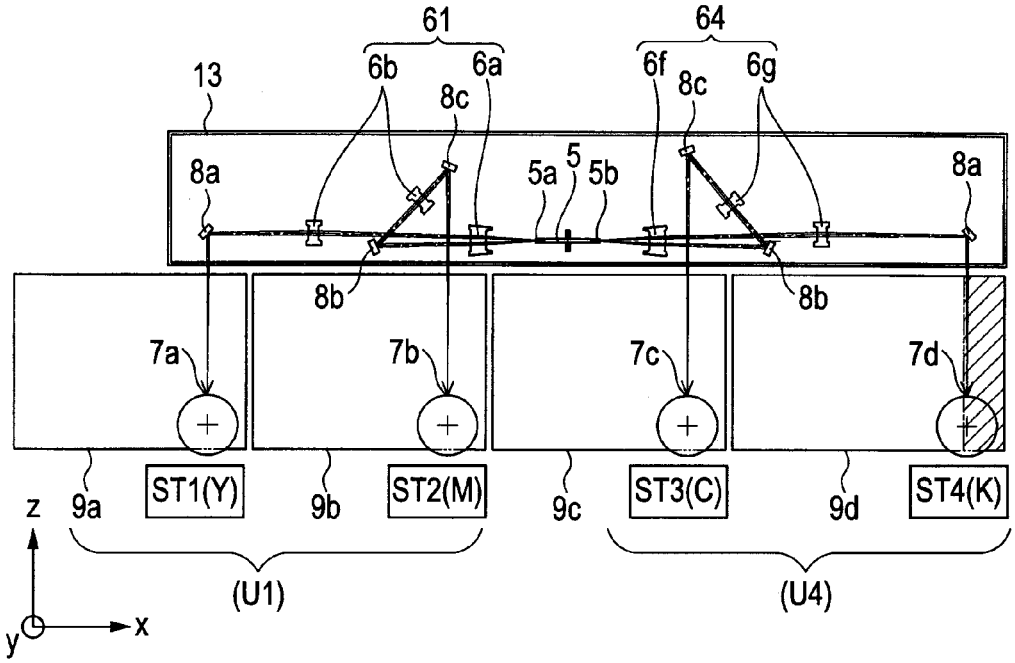
FIG. 12 is a sub-scanning sectional view of an optical scanning apparatus according to the third embodiment of the present invention.

FIG. 12 is a cross-sectional view of a main portion in the sub-scanning direction (sub-scanning sectional view) of an optical scanning apparatus according to this embodiment. In FIG. 12, the same elements as those illustrated in FIG. 4 are denoted by the same reference symbols.

In this embodiment, the light beam entering the deflecting surface of the deflecting unit of the first scanning unit U1 is parallel light beam, while the light beam entering the deflecting surface of the deflecting unit of the second scanning unit U4 is divergent light beam in the main scanning section. With this configuration, the optical path length of the first scanning unit and the optical path length of the second scanning unit have a difference of 20 mm, to thereby adapt to the increase in the black cartridge capacity.

The divergent light beam entering the deflecting surface of the deflecting unit is realized by decreasing the power of a condenser lens of the incident optical system LB in the main scanning section.

Further, the imaging optical system 61 and the imaging optical system 64 have the same fθ coefficient, and hence the first scanning unit U1 and the second scanning unit U4 also have the same scanning speed of the light beam on the surface to be scanned. Therefore, there is no need to change the frequency of the image clock signal for each scanning unit.

Note that, in this embodiment, the light beams incident on different deflecting surfaces of the deflecting unit are the combination of the parallel light beam and the divergent light beam. However, as long as the object of providing different optical path lengths is attained, the light beams may be any combination of convergent light beam, parallel light beam and divergent light beam.

For example, the light beams incident on different deflecting surfaces of the deflecting unit may be a combination of divergent light beam and convergent light beam. In this case, the optical path length for the incident divergent light beam from the deflection point to the surface to be scanned may be designed longer than the case where the parallel light beam enters, while the optical path length for the incident convergent light beam from the deflection point to the surface to be scanned may be designed shorter than the case where the parallel light beam enters.

With this configuration, a sufficient difference may be provided between the optical path lengths without setting the light beams incident on different deflecting surfaces of the deflecting unit strongly diverging and strongly converging. Not setting the light beams incident on the different deflecting surfaces of the deflecting unit strongly diverging and strongly converging leads to a reduction in shift of a write start position on the surface to be scanned, which occurs due to a surface sag resulting from a manufacturing error of the deflecting surfaces of the deflecting unit.

Fourth Embodiment

Hereinafter, a fourth embodiment of the present invention is described.

Figure 13:
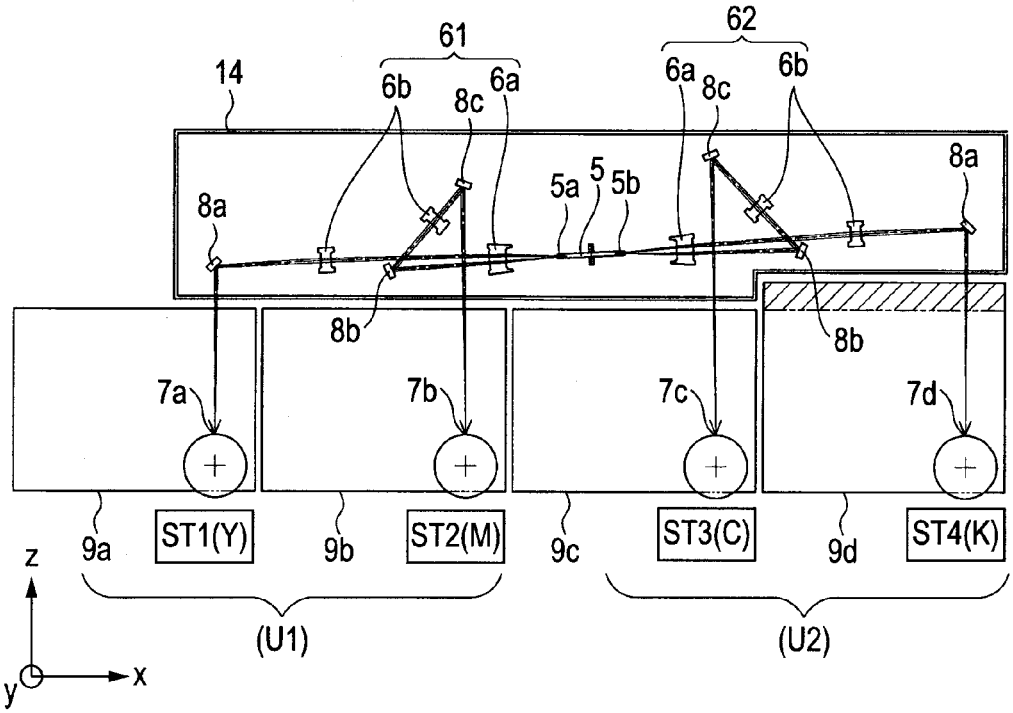
FIG. 13 is a sub-scanning sectional view of an optical scanning apparatus according to a fourth embodiment of the present invention.

FIG. 13 is a cross-sectional view of a main portion in the sub-scanning direction (sub-scanning sectional view) of an optical scanning apparatus according to this embodiment. In FIG. 13, the same elements as those illustrated in FIG. 4 are denoted by the same reference symbols.

This embodiment is different from the above-mentioned first embodiment in that, in order to increase the toner capacity of the black toner cartridge, the black toner cartridge is increased in dimension and hence in capacity with respect to the other toner cartridges in a direction perpendicular to the parallel arrangement direction of the photosensitive drums, and in that, in accordance therewith, in the sub-scanning section, the rotational axis of the deflecting unit is inclined with respect to the direction perpendicular to the parallel arrangement direction of the photosensitive drums. Other configurations and optical actions are similar to those of the first embodiment, to thereby obtain the effects similar to those of the first embodiment.

In this embodiment, the rotational axis of the deflecting unit is inclined with respect to the direction perpendicular to the parallel arrangement direction of the photosensitive drums by 5 degrees. Further, the optical path length from the deflection point of the light beam guided to the photosensitive drum of the black toner cartridge, which is increased in toner capacity, to the surface to be scanned (optical path length through the imaging optical system 62) is set longer than the optical path length of the light beams guided to the magenta and yellow photosensitive drums (optical path length through the other imaging optical system, that is, the imaging optical system 61). With this configuration, the black toner cartridge is enlarged by the hatched portion illustrated in FIG. 13, while preventing unnecessary space from being generated between the toner cartridges of the other colors and the optical scanning apparatus.

Fifth Embodiment

Hereinafter, a fifth embodiment of the present invention is described.

Figure 14:
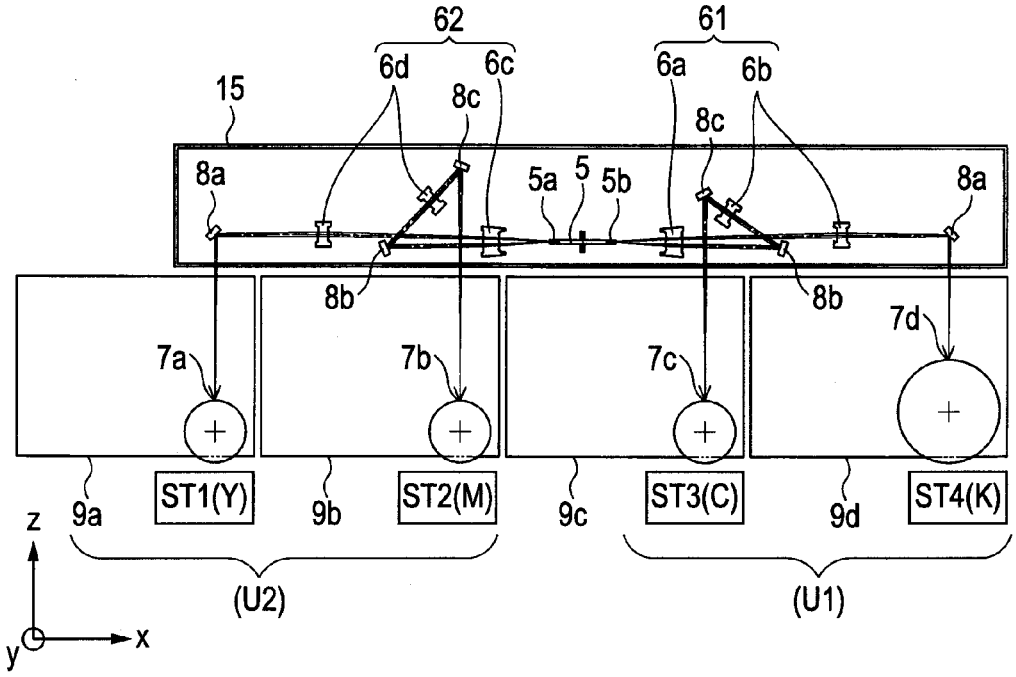
FIG. 14 is a sub-scanning sectional view of an optical scanning apparatus according to a fifth embodiment of the present invention.

FIG. 14 is a cross-sectional view of a main portion in the sub-scanning direction (sub-scanning sectional view) of an optical scanning apparatus according to this embodiment. In FIG. 14, the same elements as those illustrated in FIG. 4 are denoted by the same reference symbols.

This embodiment is different from the above-mentioned first embodiment in that the diameter of the photosensitive drum positioned farthest from the deflecting unit is larger than those of the other photosensitive drums. Other configurations and optical actions are similar to those of the first embodiment, to thereby obtain the effects similar to those of the first embodiment.

In this embodiment, the diameter of the black photosensitive drum is increased to lengthen the life of the photosensitive drum. However, in order to increase the diameter of the black photosensitive drum, the optical path length for guiding the light beam to the black photosensitive drum needs to be short.

Therefore, the first scanning unit U1 having the shorter optical path length is used on the side of the black photosensitive drum, which is increased in diameter, and the cyan photosensitive drum, and the second scanning unit U2 having the longer optical path length is used on the side of the yellow and magenta photosensitive drums. As described above, this embodiment is adaptable to the case where the photosensitive drums have different diameters.

Color Image Forming Apparatus

Figure 15:
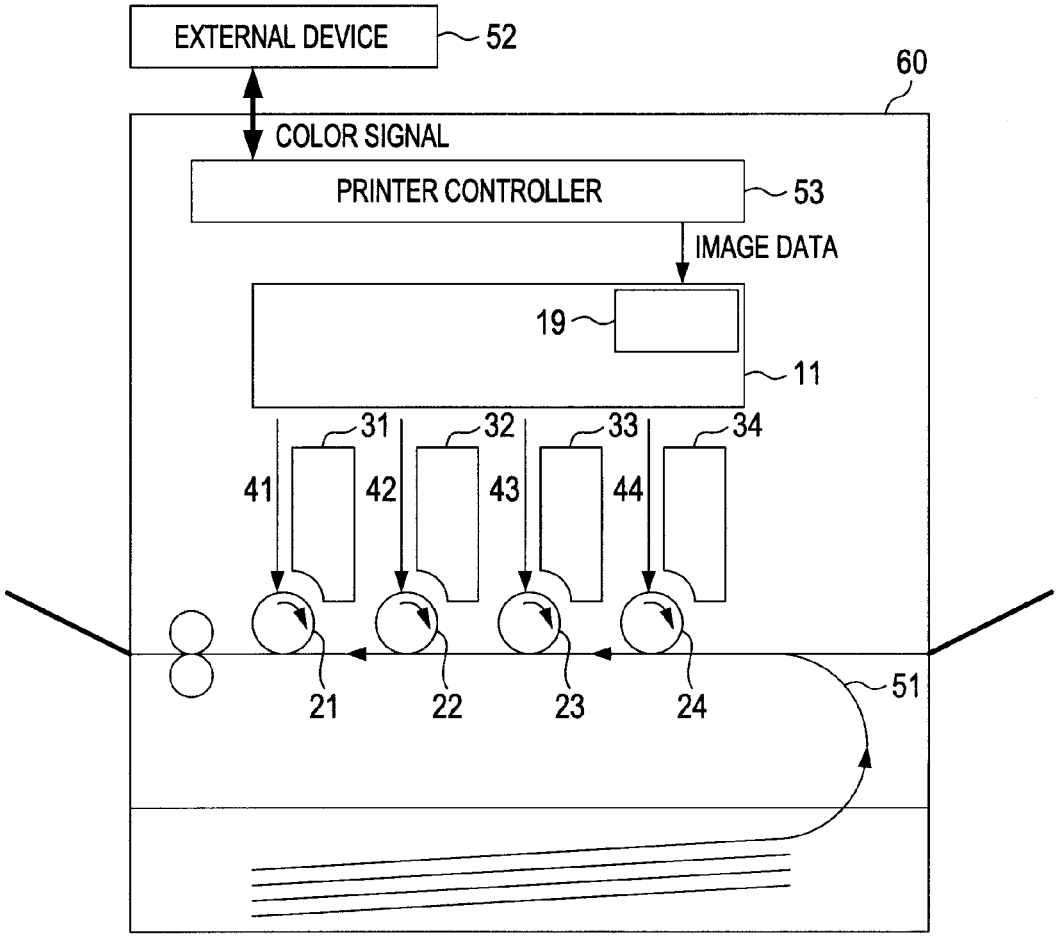
FIG. 15 is a schematic diagram of a main portion of a color image forming apparatus according to an embodiment of the present invention.

FIG. 15 is a schematic diagram illustrating a main portion of a color image forming apparatus according to an embodiment of the present invention. This embodiment describes a tandem type color image forming apparatus in which four light beams are used by an optical scanning apparatus to record image information in parallel on photosensitive members each serving as an image bearing member. In FIG. 15, a color image forming apparatus 60 includes an optical scanning apparatus 11 having the structure described in any one of the first to fifth embodiments, and a laser unit 19 including a semiconductor laser and a drive circuit therefor. The laser unit 19 receives image data from the printer controller 53 and drives the semiconductor laser (not shown) to emit light beams 41, 42, 43 and 44 modulated in accordance with the image data. Further, the drive circuit has a function of setting amounts of respective light beams (for example, variable resistor or the like), and the amounts are set so that the same amount of the latent image is obtained on each of photosensitive drums 21, 22, 23 and 24 each serving as an image bearing member. The drive circuit for the semiconductor laser is marketed as various control ICs (for example, CXA3600R manufactured by Sony Corporation or the like). The drive circuit has the amount adjustment function for adjusting the light beam to the above-mentioned amount by the variable resistor, a D/A circuit, and the like. The color image forming apparatus further includes developers 31, 32, 33 and 34, and a conveyer belt 51.

In FIG. 15, respective color signals of red (R), green (G), and blue (B) are input from an external device 52 such as a personal computer to the color image forming apparatus 60. The color signals are converted into pieces of image data D (dot data) of yellow (Y), magenta (M), cyan (C), and black (B) by the printer controller 53 in the color image forming apparatus 60. The pieces of image data D are converted into image data VIDEO in synchronization with an image clock signal and are then input to the optical scanning apparatus 11 and the laser unit 19. The light beams 41, 42, 43 and 44 which are modulated in accordance with the respective pieces of image data are emitted from the optical scanning apparatus 11. Photosensitive surfaces of the photosensitive drums 21, 22, and 24 are scanned with the light beams in a main scanning direction.

According to the color image forming apparatus of this embodiment, the optical scanning apparatus 11 uses the four light beams which respectively correspond to the respective colors of yellow (Y), magenta (M), cyan (C) and black (B). The image signals (image information) are recorded in parallel on the surfaces of the photosensitive drums 21, 22, 23 and 24, thereby printing a color image at high speed.

According to the color image forming apparatus of this embodiment, as described above, latent images of the respective colors are formed on the corresponding surfaces of the photosensitive drums 21, 22, 23 and 24 using the light beams based on the respective pieces of image data by the optical scanning apparatus 11. After that, the multi-transfer is performed on a recording material to produce a full color image.

For example, a color image reading apparatus including a CCD sensor may be used as the external device 52. In this case, the color image reading apparatus and the color image forming apparatus 60 constitute a color digital copying machine.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-147389, filed Jun. 29, 2010, which is hereby incorporated by reference herein in its entirety.

What is claimed is:

1. An image forming apparatus comprising:

first, second, third, and fourth light source units configured to emit first, second, third, and fourth light beams, respectively;

a deflecting unit having a first deflecting surface and a second deflecting surface that is different from the first deflecting surface, the first deflecting surface being configured to deflect the first and second light beams for scanning and the second deflecting surface being configured to deflect the third and fourth light beams for scanning;

a first imaging optical system configured to guide the first and second light beams deflected by the deflecting unit onto first and second surfaces to be scanned, respectively;

a second imaging optical system configured to guide the third and fourth light beams deflected by the deflecting unit onto third and fourth surfaces to be scanned, respectively; and a beam detecting optical system disposed at a position nearer the second imaging optical system than the first imaging optical system, wherein a third optical path length from the third surface to be scanned to the second deflecting surface and a fourth optical path length from the fourth surface to be scanned to the second deflecting surface are longer than a first optical path length from the first surface to be scanned to the first deflecting surface and a second optical path length from the second surface to be scanned to the first deflecting surface.

2. The image forming apparatus according to claim 1, wherein the deflecting unit is rotatable about a rotational axis that is inclined with respect to the direction perpendicular to the direction in which the surfaces to be scanned are arrayed in the sub-scanning section.

3. The image forming apparatus according to claim 1, wherein the first optical path length and the second optical path length are equal to each other and the third optical path length and the fourth optical path length are equal to each other.

4. The image forming apparatus according to claim 3, wherein:

the first imaging optical system comprises:

a first imaging optical element through which both the first and second light beams pass;

a second imaging optical element through which only the first light beam passes; and a third imaging optical element through which only the second light beam passes, the second imaging optical system comprises:

a fourth imaging optical element through which both the third and fourth light beams pass;

a fifth imaging optical element through which only the third light beam passes; and a sixth imaging optical element through which only the fourth light beam passes, the second imaging optical element and the third imaging optical element have a same shape, the fifth imaging optical element and the sixth imaging optical element have a same shape, and the first imaging optical element and the fourth imaging optical element have shapes different from each other.

5. The image forming apparatus according to claim 4, wherein the second, third, fifth, and sixth imaging optical elements have a same shape.

6. The image forming apparatus according to claim 1, further comprising:

a control unit configured to control timings of emission of the first, second, third and fourth light beams, wherein the control unit determines the timing of emission of the first and second light beams in reference to a first clock frequency, and determines the timing of emission of the third and fourth light beams in reference to a second clock frequency, and wherein the following condition is satisfied:

$$W1/W2=f1/f2,$$

where W1 represents the first clock frequency, W2 represents the second clock frequency, f1 represents fθ coefficient of the first imaging optical system, and f2 represents fθ coefficient of the second imaging optical system.

7. The image forming apparatus according to claim 5, wherein the control unit controls output light beam amounts of the first, second, third and fourth light source units to satisfy the following condition:

$$P1\times t1=P2\times t2,$$

where t1 represents a time period during which the first and second light source units emit light beam corresponding to one pixel, t2 represents a time period during which the third and fourth light source units emit light beam corresponding to one pixel, P1 represents a light amount of the first and second light beams on the first and second surface to be scanned, and P2 represents a light amount of the third and fourth light beams on the third and fourth surface to be scanned.

8. The image forming apparatus according to claim 1, wherein the following condition is satisfied:

$$1.03 \leqq Lmax/Lmin \leqq 1.20,$$

where Lmin represents the first and second optical path lengths, and Lmax represents the third and fourth optical path lengths.

* * * * *